US005244250A

United States Patent [19]

Nordmeyer

[11] Patent Number: 5,244,250

[45] Date of Patent: Sep. 14, 1993

[54] PORTABLE FOLD-UP SPORTS CHAIR

[76] Inventor: Robert A. Nordmeyer, 5034 Marmol Dr., Woodland Hills, Calif. 91364

[21] Appl. No.: 828,736

[22] Filed: Jan. 31, 1992

[51] Int. Cl.[5] ..... A47C 4/00

[52] U.S. Cl. ..... 297/59; 297/28; 297/45

[58] Field of Search ..... 297/27, 28, 45, 59

[56] References Cited

U.S. PATENT DOCUMENTS

| | | | |
|---|---|---|---|
| 2,260,735 | 10/1941 | Benjamin | 297/28 |
| 3,228,724 | 1/1966 | Resar | 297/45 |
| 4,889,383 | 12/1989 | Jones | 297/45 |
| 4,890,882 | 1/1990 | Harrington | 297/45 |

FOREIGN PATENT DOCUMENTS

| | | | |
|---|---|---|---|
| 617829 | 10/1947 | United Kingdom | 297/28 |

*Primary Examiner*—Laurie K. Crammer

*Attorney, Agent, or Firm*—Poms, Smith, Lande & Rose

[57] ABSTRACT

A portable, fold-up sports chair includes fabric seat and back portions, attached to and extending between a lightweight, collapsible tubular frame. The transverse frame members are hinged to allow the chair to be folded into a compact bundle for transportation or storage. Straps attached to the underside of the legs help prevent the chair legs from penetrating or sinking when used on a soft surface such as sand. The angle of the seat back is adjustable by means of straps which also serve as arm rests when the chair is in use.

18 Claims, 2 Drawing Sheets

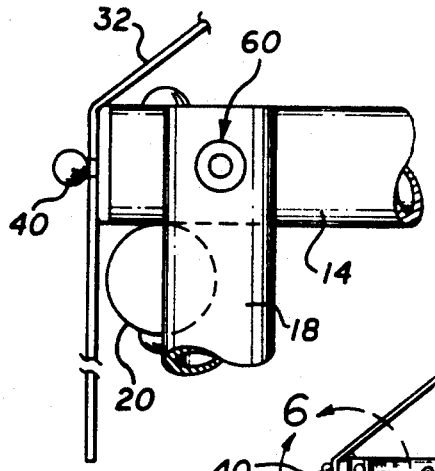
FIG. 6
FIG. 3
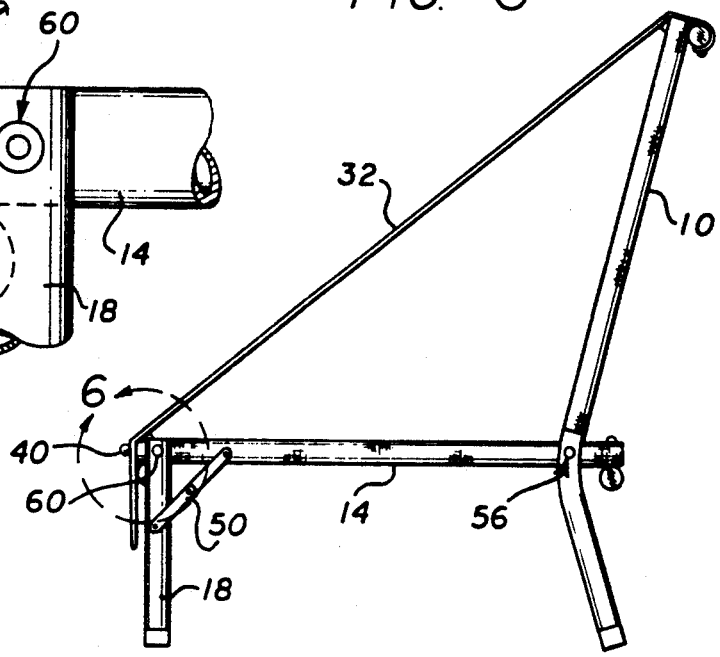
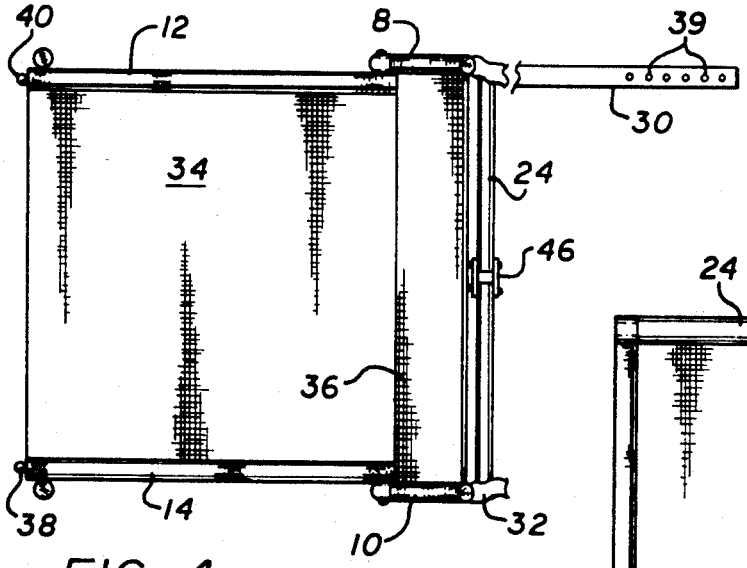
FIG. 4
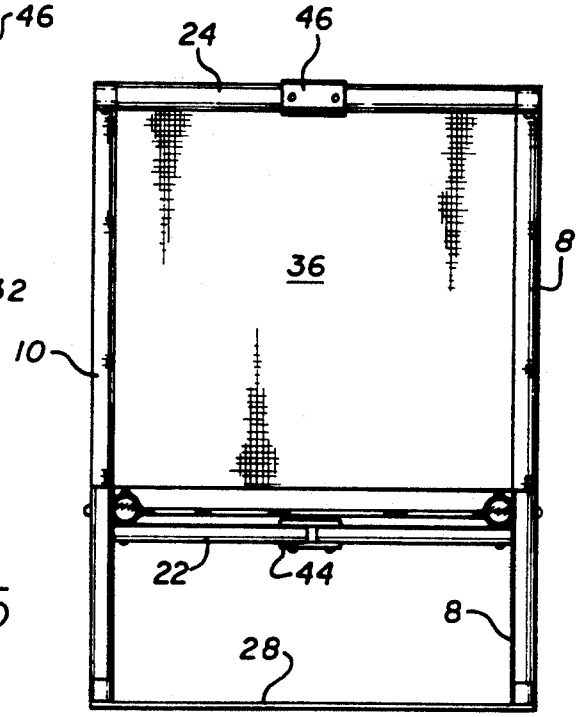
FIG. 5

PORTABLE FOLD-UP SPORTS CHAIR

FIELD OF THE INVENTION

This invention relates to portable chairs or seating apparatus designed for sport, recreational or beach use.

BACKGROUND OF THE INVENTION

Present portable chairs designed for sport or recreational use are designed so as to fold up, seat to back, to decrease size and facilitate transportation and storage. Such chairs normally include pivoting joints between the frame portions comprising the seat back and frame portions on either side of the seat. Pivoting joints may also be provided between the frame portions on either side of the seat and the front legs to allow the legs of the chair to fold flat to the seat. When folded, such chairs are substantially flat and square or rectangular in shape.

Additionally, current chair designs may include a transverse bar or horizontal frame member at the lower portion of the chair legs, as an alternative to narrow feet, to prevent the chair legs from sinking when used on a soft surface such as sand.

Accordingly, one important object of the present invention is to allow the sports chair to be folded not only seat to back as in present portable chairs, but also in a side to side manner. Such additional folding reduces the size and bulkiness of the chair in its folded state.

An additional object of the present invention is to provide arrangements for preventing the legs of a light weight sports chair from sinking into a soft supporting surface.

SUMMARY OF THE INVENTION

In accordance with the present invention, a portable, fold-up sports chair includes fabric seat and back portions, attached to and extending between a lightweight, tubular frame which collapses by means of pivotal joints and folding transverse frame members.

In accordance with one feature of the invention, transverse frame members are hinged in the middle to allow the chair to be folded in two directions, and said frame members include locking mechanisms in at least one direction to prevent inadvertent folding during use.

In accordance with another feature of the invention, straps may extend between the bottoms of legs of the chair to resist penetration into a support surface when the invention is in use. More specifically these straps may be attached to the underside of and extend between the two front upright frame members and between the two upright back side frame members. Use of the straps reduces the size and weight of the chair and may be wrapped around the folded bundle to secure it for transportation or storage.

In accordance with further features of the invention, the rear of the seat extends behind the upright back side frame members to prevent bending of the lower back transverse frame member when the invention is in use. The angle of the seat back is adjustable by means of two straps, having an adjustable effective length, which extend from the top or upper portion of the upright back side frame members to attach to the front of the chair seat.

In accordance with further aspects of the invention, the chair may be folded lengthwise into a compact bundle of approximately 4 inches in diameter and 21 inches in length, allowing for easy portability and efficient storage. Overall weight of the invention is approximately two or three pounds.

Other objects, features, and advantages of the invention will become apparent from a consideration of the following detailed description and from the accompanying drawings.

BRIEF DESCRIPTION OF THE DRAWINGS

FIG. 3 is a right side view of the fold-up chair in its assembled and unfolded state;

FIG. 4 is a top view of the fold-up chair in its assembled state showing the fabric seat and back portions, and the upper transverse frame member;

FIG. 5 is a rear view of the fold-up chair in its assembled state;

FIG. 6 is a partially broken sectional view of the frame member interconnection and right strap adjustment providing detail of the area 6 identified in FIG. 3.

DETAILED DESCRIPTION OF PREFERRED EMBODIMENT

Figure 1:
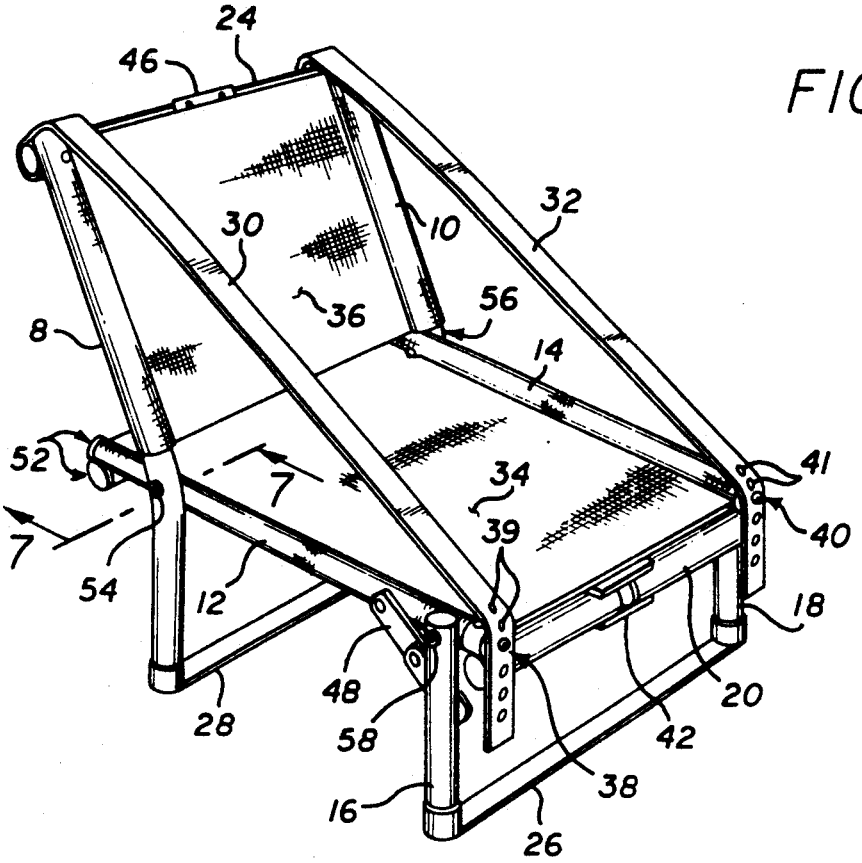
FIG. 1 is a perspective view of a portable fold-up sports chair illustrating the principles of the present invention.
Figure 2:
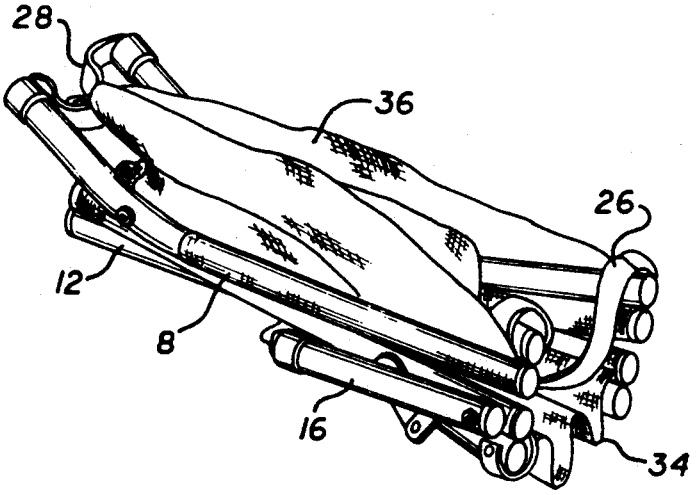
FIG. 2 shows a perspective view illustrative of the invention in its folded state.

Referring more particularly to the drawings, FIG. 1 shows a fold-up chair illustrating the principles of the invention and comprised of a lightweight tubular frame fastened with pivoting joints and hinges and including a seat and back constructed of fabric, which may for example be polypropylene. Adjustable straps connect the upright back side frame members with the front of the seat. Straps extend between the lower portions of the upright back side frame members and between the lower portions of the front upright frame members, preventing the chair legs from sinking when used on a soft surface such as sand. FIG. 2 illustrates the invention in its folded state.

Referring again to FIG. 1 it is seen that a chair consists of a left upright back side frame member 8 connected by means of a left rear pivotal joint 54 to a left seat side frame member 12 which typically includes end caps 52. The left seat side frame member 12 is connected by means of a left front pivotal joint 58 to left front upright frame member 16. A left front locking mechanism 48 further connects left front upright frame member 16 to left seat side frame member 12. The locking mechanism 48 locks in the open position to prevent collapse of the pivotal joint 58 during use. A left adjustable strap 30 extends from a fixed connection at the upper portion of left upright back side frame member 8 to a left strap adjustment 38 on left seat side frame member 12. This adjustment includes multiple apertures 39 in adjustable strap 30. To adjust the seat back angle, any of the apertures 39 can be hooked to a peg on the front of left seat side frame member 12.

A frame assembly and adjustable strap 32 on the right side of the chair mirrors the left side frame assembly and adjustable strap 30 described above. A right upright back side frame member 10 is connected by means of a right rear pivotal joint 56 to a right seat side frame member 14. The side seat frame member 14 is connected by means of a right front pivotal joint 60 to right front upright frame member 18 as shown in FIG. 3. A right front locking mechanism 50 in FIG. 3 further connects upright frame member 18 to seat side frame member 14. The locking mechanism 50 locks in the open position to prevent collapse of the pivotal joint 60 during use. A right adjustable strap 32 extends from a fixed connection at the upper portion of right upright back side frame member 10 to a right strap adjustment 40 on right seat side frame member 14. The strap adjustment 40 is comprised of multiple apertures 41 in adjustable strap 32. To adjust the seat back angle, any of the apertures 41 can be hooked to a peg on the front of right seat side frame member 14.

A fabric seat back 36 extends between and attaches to upright back side frame members 8, 10. A fabric seat 34 extends between and attaches to seat side frame members 12, 14. A front transverse frame member 20 extends between and is attached to seat side frame members 12, 14 by means of pivotal joints. The transverse frame member 20 is bisected by front transverse locking pivot assembly 42, forming two segments of equivalent length which can be collapsed inward. The locking pivot assembly 42 includes a "U" shaped outer sleeve open on one side to allow the segments of the transverse frame member 20 to pivot on riveted joints. The locking pivot assembly 42 prevents outward collapse of transverse frame member 20 while the chair is in use.

A front flexible support band 26 extends between and is attached to the lower portion of front upright frame members 16, 18. A rear flexible support band 28 extends between and is attached to the lower portion of upright back side frame members 8, 10.

In FIG. 2, the invention is illustrated as it appears when folded. The frame members 8, 10, 12, 14, 16, 18, 20, 22, 24 are roughly parallel. The three transverse frame members 20, 22, 24 are folded in half at the hinged joints 42, 44, 46. The upright back side frame members 8, 10 and the front upright frame members 16, 18 pivot with side seat frame members 12, 14. The fabric seat 34 and back 36 wrap around the bundle to prevent spilling. The straps 26, 28, 30, 32 may be further wrapped around the collapsed chair to secure the bundle.

Referring next to FIG. 3 it is seen that the upright back side frame members 8, 10 are angled backward above the pivot joints 54, 56 to the seat side frame members 12, 14 and also below pivot joints 54, 56. The foregoing angles of construction reduce the tendency of the chair to tilt backward while in use and provide a slightly reclined sitting position for the user. Further inclination of the back portion is facilitated by means of the adjustable straps 30, 32 and the strap adjustments 38, 40 which allow the angle of the back side frame members to be altered with respect to the surface upon which the chair is used.

The seat side frame members 12, 14 extend behind the upright back side frame members 8, 10. The lower back transverse frame member is attached to the underside of seat side frame members 12, 14 behind the upright back side frame members 8, 10. Such construction minimizes the risk of bending of the lower back transverse frame member 22 and center hinge 44 when the chair is in use.

FIG. 4 is a view of the sports chair from above. The left adjustable strap 30 attaches to the upper back transverse frame member 24 at the upper portion of upright back side frame member 8.

FIG. 5 shows the sports chair from the rear. A lower back transverse frame member 22 extends between and attaches to seat side frame members 12, 14 by means of pivotal joints. Lower back transverse member 22 is bisected by lower rear transverse locking pivot assembly 44, forming two segments of equivalent length which can be collapsed inward. The locking pivot assembly 44 prevents outward collapse of transverse frame member 22 while the chair is in use.

An upper back transverse frame member 24 extends between and attaches to upright back side frame members 8, 10 by means of pivotal joints. The upper back transverse member 24 is bisected by upper rear transverse locking pivot assembly 46, forming two segments of equivalent length which can be collapsed inward. The locking pivot assembly 46 prevents upward collapse of upper back transverse frame member 24 while the chair is in use.

FIG. 6 is a partially broken sectional view of the interconnection between the right front upright frame member 18 and the right seat side frame member 14. The aforementioned interconnection is made through the use of a single rivet forming right front pivotal joint 60 and includes right front locking mechanism 50. The interconnection as described allows the right front upright frame member 18 to be folded in toward the right seat side frame member 14 when the chair is collapsed. The right strap adjustment 40 consists of apertures or eyelets in the right adjustable strap 32 and a peg or hook at 40. The adjustment described allows the angle of the seat back to be increased or decreased during use by selection of different apertures in the aforementioned adjustable strap, thereby altering the effective length of right adjustable strap 32. The user of the chair, while seated, may use the adjustable straps 30, 32 as armrests. An interconnection and strap adjustment mechanism, identical to that described above, is provided on the left side of the chair as shown in FIG. 1.

Figure 7:
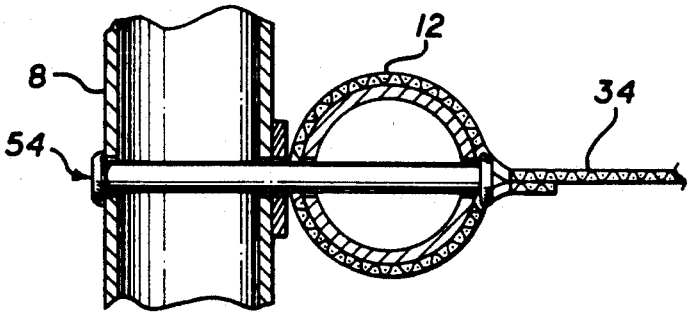
FIG. 7 is a partially broken cutaway view of the joint formed by the left upright back side and left seat side frame members along the line 7—7 of FIG. 1.

FIG. 7 illustrates a typical pivotal rivet connection between two frame members. The rivet 54 is installed through both sections of tubular frame members with a washer placed between the frame members. FIG. 7 also shows a cutaway cross-section of the tubing used for frame members 8, 10, 12, 14, 16, 18, 20, 22, 24. The tubing in the described embodiment is hollow with an outside diameter of ¾ inches and a nominal wall thickness of approximately 0.049 inches.

As shown in FIG. 7 and elsewhere throughout the drawings the fabric comprising the seat 34 and back 36 is attached to the upright back side frame members 8, 10 and the seat side frame members 12, 14 by completely circumscribing the frame member and reattaching to the under or back side of the fabric by, for example and not as limitation, sewing or gluing.

In conclusion, it is to be understood that the foregoing detailed description and the accompanying drawings illustrate one preferred embodiment of the invention. Variations from this preferred design may, of course, be made. Thus, by way of example and not of limitation, the transverse locking pivot assemblies 42, 44, 46 could be replaced by inside or outside slidable sleeves or rods. The lower back transverse frame member 22 could be mounted on the top of the seat side frame members 12, 14 or on the upright back side frame members 8, 10. The flexible support bands 26, 28 could be replaced by collapsible frame members similar in construction and operation to transverse frame members 20, 22, 24. The effective length of the adjustable straps 30, 32 could be altered by adjustments located at either end of such straps or along the length between the ends. Adjustment of the length of straps 30, 32 could be provided for example by Velcro type connection, buckles or sliding loops. The adjustable straps 30, 32 could be attached either to the upright back side frame members 8, 10 or to the upper back transverse frame member 24.

The dimensions of the sports chair may be varied without altering the principles described herein. In one working model, the assembled height of the sports chair is approximately 21 inches but is preferably less than 25 inches. The seat and back portions are approximately 15 inches to 17 inches square but are preferably less than 22 inches square. The seat portion of the working model is approximately 7 inches from the support surface but is preferably less than 10 inches from such surface. The wall thickness of the tubing used for frame members in the model is 0.049 inches, although bigger or smaller thicknesses, for example 0.060 inches could be used. Accordingly, it is to be understood that the invention is not limited to the precise arrangements shown in the drawings and as described hereinabove.

What is claimed is:

1. A portable, fold-up sports chair comprising:

a back portion including two upright back side frame members, each of said upright back side frame members having a lower end each said lower end being in substantially the same vertical plane as the respective upright back side frame members for abutting a supporting surface;

fabric secured to and extending between said side frame members;

a seat portion including two generally horizontal seat side frame members, and fabric secured to and extending between said seat side frame members;

said seat side frame members being pivotally secured to said back side frame members;

first, second, and third transverse frame members, said first transverse frame member interconnecting front ends of said two seat side frame members, said second transverse frame member interconnecting upper ends of said two back side frame members, and said third transverse frame member interconnecting two seat side frame members near the locations where said back side frame members are pivotally secured to said seat side frame members each of said transverse frame members being formed of two portions each forming about half of the frame member, and said portions being pivotally secured to one another and to one of said side members; and means for folding said frame members so that they are substantially parallel and immediately adjacent one another to form an easily portable assembly.

2. A portable, fold-up sports chair as defined in claim 1 wherein each of said transverse frame members includes mechanical arrangements for preventing bending of said transverse frame members in at least one direction.

3. A portable, fold-up sports chair as defined in claim 1 including at least two independent leg frame members pivotally secured to the front of said seat side frame members.

4. A portable, fold-up sports chair comprising:

a back portion including two upright back side frame members the upper portion of which is reclined with respect to a support surface, and fabric secured to and extending between said side frame members;

a seat portion including two generally horizontal seat side frame members, and fabric secured to and extending between said seat side frame members;

said seat side frame members being pivotally secured to said back side frame members;

first, second, and third transverse frame members, said first transverse frame member pivotally connected to the front ends of said two seat side frame members, said second transverse frame member pivotally connected to the upper ends of said two back side frame members, and said third transverse frame member pivotally connected to said two seat side frame members near the locations where said back side frame members are pivotally secured to said seat side frame members;

each of said transverse frame members being formed of two portions each forming about half of the frame member, and said portions being pivotally secured to one another and to one of said side members; and flexible bands extending between and attached to the lower ends of upright frame members, whereby said upright frame members will resist penetration into a support surface;

whereby said chair may be folded up with all of said frame members being substantially parallel and immediately adjacent one another to form an easily portable assembly.

5. A portable, fold-up sports chair as defined in claim 4 wherein the length of said chair when folded is approximately 21 inches.

6. A portable, fold-up sports chair as defined in claim 4 whereby the diameter of the chair assembly when folded is less than 5 inches.

7. A portable, fold-up sports chair as defined in claim 4 wherein the weight of said chair is less than 3 pounds.

8. A portable, fold-up sports chair as defined in claim 4 including leg frame members of less than 10 inches in length pivotally secured to the front of said seat side frame members, and including means to secure said leg frame members in a fixed position during use.

9. A portable, fold-up sports chair as defined in claim 8 wherein said transverse frame members are less than 20 inches in length.

10. A portable, fold-up sports chair as defined in claim 9 wherein said side, transverse and leg frame members are constructed of lightweight metal tubing of approximately ¾ inches outside diameter.

11. A portable, fold-up sports chair comprising:

a back portion including two upright back side frame members, each of said upright back side frame members having a lower end each said lower end being in substantially the same vertical plane as the respective upright back side frame member for abutting a supporting surface;

fabric secured to and extending between said side frame members;

a seat portion including two generally horizontal seat side frame members, and fabric secured to and extending between said seat side frame members;

said back portion pivotally connected to said seat portion;

transverse frame members, each of said transverse frame members extending between said upright back side frame members or between said side frame members wherein each of said transverse frame members is amenable to reduction of its effective length; and said chair further including means for folding said frame members up so that they are substantially parallel extending in a predetermined direction and engaging one another.

12. A portable, fold-up sports chair as defined in claim 11 wherein a rear transverse frame member is located behind said pivotal connection between said back portion and said seat portion.

13. A portable, fold-up sports chair as defined in claim 11, said chair further comprising means for adjusting the angle of said back portion with respect to said seat portion.

14. A portable, fold-up sports chair as defined in claim 11 including leg frame members secured to a forward portion of said seat side frame members.

15. A portable, fold-up sports chair comprising:

a back portion including two upright back side frame members, and fabric secured to and extending between said side frame members;

a seat portion including two generally horizontal seat side frame members, and fabric secured to and extending between said seat side frame members;

said seat side frame members being pivotally secured to said back side frame members;

first, second, and third transverse frame members, said first transverse frame member interconnected the front ends of said two seat side frame members, said second transverse frame member interconnecting the upper ends of said two back side frame members, and said third transverse frame member interconnecting two side frame members near the locations where said back side frame members are pivotally secured to said seat side frame members; and each of said transverse frame members being formed of two portions each forming about half of the frame member, and said portions being pivotally secured to one another ant to one of said side members;

leg frame members pivotally secured to the front of said seat side frame members; and a flexible band interconnecting the lower ends of said leg frame members;

whereby said chair may be folded up with all of said frame members being substantially parallel and immediately adjacent one another to form an easily portable assembly, and whereby said leg frame members will resist penetration into a support surface.

16. A portable, fold-up sports chair comprising:

a back portion including two upright back side frame members, and fabric secured to and extending between said seat side frame members;

said seat side frame members being pivotally secured to said back side frame members;

first, second, and third transverse frame members, said first transverse frame member interconnecting front ends of said two seat side frame members, said second transverse frame member interconnecting upper ends of said two back side frame members, and said third transverse frame member interconnecting two side frame members near the locations where said back side frame members are pivotally secured to said seat side frame members;

each of said transverse frame members being formed of two portions each forming about half of the frame member, and said portions being pivotally secured to one another and to one of said side members; and leg frame members pivotally secured to a forward portion of said seat side frame members;

in which said back side frame members extend below the seat side frame members by a distance comparable to the length of said leg frame members;

whereby said chair may be folded up with all of said frame members being substantially parallel and immediately adjacent one another to form an easily portable assembly.

17. A portable, fold-up sports chair comprising:

a back portion including two upright back side frame members, and fabric secured to and extending between said side frame members;

a seat portion including two generally horizontal seat side frame members, and fabric secured to and extending between said seat side frame members;

said seat side frame members being pivotally secured to said back side frame members;

first, second, and third transverse frame members, said first transverse frame member interconnecting front ends of said two seat side frame members, said second transverse frame member interconnecting upper ends of said two back side frame members, and said third transverse frame member interconnecting two side frame members near the locations where said back side frame member are pivotally secured to said seat side frame members;

each of said transverse frame members being formed of two portions each forming about half of the frame member, and said portions being pivotally secured to one another and to one of said side mcmbers; and a flexible band interconnecting the lower ends of said back side frame members so that the lower ends will resist penetration into a support surface when said chair is in use;

whereby said chair may be folded up with all of said frame members being substantially parallel and immediately adjacent one another to form an easily portable assembly.

18. A portable, fold-up sports chair comprising:

a back portion including two upright back side frame members, and fabric secured to and extending between said side frame members;

a seat portion including two generally horizontal seat side frame members, and fabric secured to and extending between said seat side frame members;

said back portion pivotally connected to said seat portion;

transverse frame members, each of said transverse frame members extending between said upright back side frame members or between said seat side frame members wherein each of said transverse frame members is amenable to reduction of its effective length;

leg frame members secured to a forward portion of said seat side frame members; and flexible support bands extending between said upright back side frame members and between said leg frame members;

whereby said support bands will resist penetration into a support surface and whereby said chair may be folded up in a compact bundle to form an easily portable assembly.

* * * * *